US008512929B2

(12) United States Patent
Iwatsuki et al.

(10) Patent No.: US 8,512,929 B2
(45) Date of Patent: Aug. 20, 2013

(54) LATENT ELECTROSTATIC IMAGE DEVELOPING CARRIER, TWO-COMPONENT DEVELOPER AND IMAGE FORMING METHOD

(75) Inventors: Hitoshi Iwatsuki, Shizuoka (JP); Kimitoshi Yamaguchi, Shizuoka (JP); Minoru Masuda, Shizuoka (JP); Yutaka Takahashi, Kanagawa (JP); Koichi Sakata, Shizuoka (JP); Toyoaki Tano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 407 days.

(21) Appl. No.: 12/879,722

(22) Filed: Sep. 10, 2010

(65) Prior Publication Data

US 2011/0065037 A1 Mar. 17, 2011

(30) Foreign Application Priority Data

Sep. 14, 2009 (JP) ..... 2009-212487
Aug. 31, 2010 (JP) ..... 2010-193123

(51) Int. Cl.
*G03G 9/00* (2006.01)

(52) U.S. Cl.
USPC ..... 430/111.4; 430/108.6; 430/111.1; 430/111.35; 430/120.1; 430/122.4

(58) Field of Classification Search
USPC ..... 430/111.35, 111.1, 111.4, 122.4, 430/108.6, 120.1
See application file for complete search history.

(56) References Cited

U.S. PATENT DOCUMENTS

| | | | | |
|---|---|---|---|---|
| 7,381,513 | B2 | 6/2008 | Suzuki et al. | |
| 7,468,233 | B2 | 12/2008 | Nagayama et al. | |
| 7,527,908 | B2 | 5/2009 | Iwatsuki et al. | |
| 7,553,598 | B2 | 6/2009 | Suzuki et al. | |
| 7,592,116 | B2 | 9/2009 | Suzuki et al. | |
| 2006/0210905 | A1 | 9/2006 | Imahashi et al. | |
| 2007/0015078 | A1 * | 1/2007 | Suzuki et al. | 430/111.1 |
| 2007/0048652 | A1 | 3/2007 | Imahashi et al. | |
| 2007/0243482 | A1 | 10/2007 | Yamaguchi et al. | |
| 2008/0063969 | A1 | 3/2008 | Yamaguchi et al. | |
| 2008/0073252 | A1 | 3/2008 | Yamaguchi et al. | |
| 2008/0096121 | A1 | 4/2008 | Iwatsuki et al. | |
| 2008/0152393 | A1 | 6/2008 | Nagayama et al. | |
| 2008/0213684 | A1 | 9/2008 | Nagayama et al. | |
| 2008/0227004 | A1 | 9/2008 | Yamaguchi et al. | |
| 2009/0092920 | A1 | 4/2009 | Nagayama et al. | |

FOREIGN PATENT DOCUMENTS

| | | |
|---|---|---|
| JP | 54-155048 | 12/1979 |
| JP | 57-40267 | 3/1982 |
| JP | 58-108548 | 6/1983 |
| JP | 58-108549 | 6/1983 |
| JP | 59-166968 | 9/1984 |

(Continued)

*Primary Examiner* — Thorl Chea
(74) *Attorney, Agent, or Firm* — Oblon, Spivak, McClelland, Maier & Neustadt, L.L.P.

(57) ABSTRACT

A latent electrostatic image developing carrier including a carrier core material, and a coating layer containing a resin and provided on a surface of the carrier core material, wherein the coating layer includes a particulate material containing at least first fine conductive particles and second fine conductive particles, and wherein the first fine conductive particles and the second fine conductive particles satisfy the relationships expressed by Expressions 1 and 2, $3 \leqq D1/D2 \leqq 15$ . . . Expression 1, where D1 denotes a dispersed particle diameter of the first fine conductive particles and D2 denotes a dispersed particle diameter of the second fine conductive particles, and $-7E \leqq R1 \times R2 \leqq 8E$ . . . Expression 2, where R1 denotes a powder specific resistance of the first fine conductive particles and R2 denotes a powder specific resistance of the second fine conductive particles.

20 Claims, 2 Drawing Sheets

(56) References Cited

FOREIGN PATENT DOCUMENTS

| | | |
|---|---|---|
| JP | 1-19584 | 4/1989 |
| JP | 3-628 | 1/1991 |
| JP | 5-273789 | 10/1993 |
| JP | 6-202381 | 7/1994 |
| JP | 7-140723 | 6/1995 |
| JP | 8-6307 | 1/1996 |
| JP | 8-179570 | 7/1996 |
| JP | 8-286429 | 11/1996 |
| JP | 9-160304 | 6/1997 |
| JP | 2683624 | 8/1997 |
| JP | 11-184167 | 7/1999 |
| JP | 11-202560 | 7/1999 |
| JP | 2006-39357 | 2/2006 |
| JP | 4234090 | 12/2008 |

* cited by examiner

LATENT ELECTROSTATIC IMAGE DEVELOPING CARRIER, TWO-COMPONENT DEVELOPER AND IMAGE FORMING METHOD

BACKGROUND OF THE INVENTION

1. Field of the Invention

The present invention relates to a carrier and a developer for developing latent electrostatic images in electrophotography, electrostatic recording, electrostatic printing, or the like; and an image forming method.

2. Description of the Related Art

In image formation based on an electrophotographic process, a latent electrostatic image is formed on a latent electrostatic image bearing member containing a photoconductive material or the like, charged toner particles are made adhere onto the latent electrostatic image to form a toner image (visible image), and then the toner image is transferred onto a recording medium, such as paper, and fixed on the recording medium to be an output image. In recent years, there have been rapid developments from monochrome image technologies toward full-color image technologies of copiers and printers using electrophotographic processes, and the market of full-color image technologies tends to expand.

Typically, in color image formation based on a full-color electrophotographic process, all colors are reproduced by superimposing three primary color toners of yellow, magenta, and cyan or four color toners with black color toner added to the three primary colors. Therefore, to obtain a full-color image having excellence in color-reproducibility and color vividness, the surface of the fixed toner image must be smoothed and evened to some extent to reduce scattering of light. For this reason, there were so many conventional types of full-color copiers or the like which have a middle level of image glossiness to high level image glossiness of 10% to 50%.

Typically, as a method of fixing a dry toner image on a recording medium, a contact-heating fixing method is heavily used in which a roller or belt having a smooth surface is heated and the surface is press-contacted with a toner. Such a fixing method achieves high thermal efficiency, enables high-speed fixation, and enables imparting glossiness and transparency to color toners, but on the other hand, a so-called "offset phenomenon" is liable to take place in which a part of toner image is attached to a surface of a fixing roller and then transferred onto another image, because it is necessary that the surface of a heat-fixing member be brought in contact with a toner in a melted state under application of pressure and then be separated from the heat-fixing member.

For the purpose of preventing the offset phenomenon, a method is typically employed in which the surface of a fixing roller is formed of a silicone rubber, a fluororesin or the like, which has excellent releasing properties and further, a releasing oil for preventing adhesion of toner, such as a silicone oil, is applied on the surface of the fixing roller. This method is extremely effective in preventing toner offset, however, it requires a device for supplying the releasing oil, and has a problem that the fixing device becomes large in size, and is unsuitable for downsizing of the fixing device. For this reason, in monochrome image formation, there is a tendency to employ an oil-less system where no oil is applied to a fixing roller or a system that requires only a small amount of oil applied to a fixing roller, by using a toner whose viscoelasticity in the melted state is increased by adjusting molecular weight distribution of a binder resin, and which contains a releasing agent such as wax in a toner so that the melted toner does not internally fracture.

Meanwhile, also in full-color image formation, similarly to monochrome image formation, there is a tendency to employ oil-less systems for the purpose of achieving downsizing and structural simplification of fixing devices. In full-color image formation, in order to smooth the surface of a fixed toner image for improving color reproducibility, it is however necessary to reduce the viscoelasticity of toner in the molten state, and thus an offset phenomenon is more likely to occur, as compared to the formation of monochrome images which have no glossiness. Thus, in the full-color image formation, it is difficult to employ oil-less systems in a fixing device and to apply only a small amount of oil. When a toner containing a releasing agent is used, the transferability of the toner onto a recording medium degrades due to increased adhesiveness of the toner. Further, the releasing agent in the toner contaminates a frictional charge member such as a carrier, and the chargeability of the toner degrades, causing a degradation of the durability.

On the other hand, with respect to a carrier, there has been a method in which a hard and high-strength coating layer is formed on a carrier using an appropriate resin material for the purposes of preventing toner component-filming on a surface of carrier, uniformly forming the surface of the carrier, preventing oxidation of the surface of the carrier, preventing reduction in moisture sensitivity, prolonging developer life, preventing the carrier from adhering on surfaces of photoconductors, protecting photoconductors from flaws and frictions which are caused by the carrier, controlling charge polarity, and adjusting the charged amount or the like. There have been carriers proposed so far, for example, a carrier which is coated with a specific resin material (see Japanese Patent Application Laid-Open (JP-A) No. 58-108548); a carrier in which various additives are added to a coating layer (see Japanese Patent Application Laid-Open (JP-A) Nos. 54-155048, 57-40267, 58-108549, 59-166968, and 06-202381, and Japanese Patent Application Publication (JP-B) Nos. 01-019584, and 03-000628); a carrier having additives adhered on the surface thereof (see Japanese Patent Application Laid-Open (JP-A) No. 05-273789); a carrier in which conductive particles each having a diameter greater than the thickness of a coating layer are included in the coating layer (see Japanese Patent Application Laid-Open (JP-A) No. 09-160304), and the like. In addition, Japanese Patent Application Laid-Open No. 08-006307 proposes to use a carrier-coating material which contains a main component of a benzoguanamine-n-butyl alcohol-formaldehyde copolymer. Japanese Patent (JP-B) No. 2683624 proposes to use a cross-linking product of a melamine resin and acrylic resin as a carrier coating material.

However, with these related art approaches, durability and prevention of carrier adhesion are not sufficiently achieved. Further, with respect to durability, there are problems with the amount of toner spent on the surface of carrier, destabilization of the charged amount associated with the toner spent, reduction in the amount of the coating layer caused by abrasion of resin coating film, and reduction in resistance associated with the reduced amount of the coating layer. Therefore, with the carrier according to these related arts, there still remain problems that quality of copied images is degraded as the number of copied sheets increases, although excellent images can be formed in early stage of image formation. A carrier leaves room for improvement.

In response to demands for being faster and more beautiful, high-quality of image, and speeding-up are remarkably progressing in the area of image forming apparatus. In accordance with the movements, the amount of stress that a developer should go through has increased dramatically, and carriers that have been said to be long-lived are unable to have a sufficient operating life. In addition, conventionally, carbon black is frequently used as a resistance controlling agent of carrier, however, there is a fear of smearing a color image with carbon black, and such a smear is caused by exfoliated film of the used resin coating and/or desorption of carbon black. Therefore, various methods have been proposed as a measure to counter the problem and effectively used.

For example, a carrier is formed by making a conductive material (carbon black) reside on the surface of a core material, and the conductive material does not reside in a resin coating layer (see Japanese Patent Application Laid-Open (JP-A) No. 07-140723). The carrier has a concentration gradient of carbon black in the direction of the thickness of a coating layer, in which the concentration of the carbon black is gradually lowered toward the surface of the coating layer, and the carbon black does not reside on the surface of the coating layer (see Japanese Patent Application Laid-Open (JP-A) No. 08-179570). A two-layered coating type carrier is proposed, in which the carrier includes an inside coating layer and a surface coverage layer, the inside coating layer contains a conductive carbon on surfaces of core material particles, and the surface coating layer contains a white conductive material on the inside coating layer (see Japanese Patent Application Laid-Open (JP-A) No. 08-286429). However, these proposals cannot respond to the highly-stressful movements in recent years, and toner smears on images become more and more problematic, and production of carrier leaves room for improvement.

As a drastic measure against such smears on images, it is obvious that non-usage of carbon black which may cause smears on images is the most effective measure. However, when carbon black alone is not used in a carrier, as mentioned above, resistance of the carrier is increased, because carbon black is characterized in its low resistance. Generally, when a carrier having high resistance is used as a developer, with an image having a large surface area of copied image, the image density in the center portion is very low, only edge portions of the copied image are represented with high density, and it is a so-called image that the edge effect is sharply represented. When an image is represented with letters and thin lines, a brilliant image is formed because of the edge effect, however, when an image is represented in neutral color tone, such a carrier has an disadvantage in that images having very poor reproducibility are formed.

Generally, for resistance controlling agents other than carbon black, for example, titanium oxide, zinc oxide or the like are known in the art, however, as to an effect of reducing the resistance, titanium oxide and zinc oxide do not have effect enough to replace carbon black. Accordingly, such resistance controlling agents do not lead to a solution of the problem, and there are still demands for further improvements and developments in carrier.

Also, JP-A No. 11-202560 discloses a carrier whose resistance has been adjusted using an oxide doped with antimony. However, use of antimony is problematic in terms of safety to human and environment. In addition, tin oxide powder containing antimony assumes bluish color, causing the same problem as in carbon black; i.e., the color of the toner is impaired.

Meanwhile, it is conventionally known that a core material is covered with a coating layer(s) containing two different fine particles. For example, JP-A No. 11-184167 discloses a coated carrier including a core material, a first coating layer on the core material, and a second coating layer on the first coating layer, wherein the first coating layer contains needle- or scale-like conductive powder conductive particles and the second coating layer contains conductive particles. JP-A No. 2006-39357 discloses a technique of adjusting resistance using a conductive filler of tin dioxide and indium oxide. The conductive filler has a narrow range within which the resistance can be adjusted, and thus, involves the occurrence of abnormal images (e.g., edge images and halo images) caused depending on the resistance of the carrier. In addition, from the viewpoints of, for example, durability, cost and permanent usability of indium (rare metal), the conductive filler poses various problems and there is room to improve practical use thereof. Under such circumstances, demand has arisen for fine conductive particles which can be controlled in resistance in a wider range, which involves no color staining, and which is made of a material whose reserves are abundant.

BRIEF SUMMARY OF THE INVENTION

The present invention solves the existing problems pertinent in the art and aims to achieve the following objects.

Specifically, the present invention provides a carrier and a two-component developer which can be controlled in resistance in a wide range, which involve no carrier adhesion, which provide good reproducibility of thin lines such as letters, which form high-fineness images with suppressed edge effects and without color stains, which stably change in charge amount even when the amount of toner consumed is small, which change in charge amount and resistance to a small extent with increasing of the running and thereby overcoming failures such as toner scattering and uneven image density, and which can maintain good image quality over a long period of time. The present invention also provides an image forming method using the two-component developer.

Means for solving the above-described problems are as follows.

<1>A latent electrostatic image developing carrier used for a two-component developer containing at least a toner and a carrier, the latent electrostatic image developing carrier including:

a carrier core material, and a coating layer containing a resin and provided on a surface of the carrier core material, wherein the coating layer includes a particulate material containing at least first fine conductive particles and second fine conductive particles, wherein the first fine conductive particles and the second fine conductive particles satisfy the relationships expressed by Expressions 1 and 2, $$3 \leqq D1/D2 \leqq 15 \qquad \text{Expression 1}$$

where D1 denotes a dispersed particle diameter of the first fine conductive particles and D2 denotes a dispersed particle diameter of the second fine conductive particles, and $$-7E \leqq R1 \times R2 \leqq 8E \qquad \text{Expression 2}$$

where R1 denotes a powder specific resistance of the first fine conductive particles and R2 denotes a powder specific resistance of the second fine conductive particles.

<2> The latent electrostatic image developing carrier according to <1>, wherein the first fine conductive particles and the second fine conductive particles satisfy the relationship expressed by Expression 1-A:

$$3 \leqq D1/D2 \leqq 10 \qquad \text{Expression 1-A}$$

<3> The latent electrostatic image developing carrier according to <1> or <2>, wherein the first fine conductive particles and the second fine conductive particles satisfy the relationship expressed by Expression 2-A:

$$-5E \leqq R1 \times R2 \leqq 7.5E \quad \text{Expression 2-A}$$

<4> The latent electrostatic image developing carrier according to any one of <1> to <3>, wherein the first fine conductive particles and the second fine conductive particles satisfy the relationship expressed by Expression 1-B:

$$7 \leqq D1/D2 \leqq 8 \quad \text{Expression 1-B}$$

<5> The latent electrostatic image developing carrier according to any one of <1> to <4>, wherein the first fine conductive particles and the second fine conductive particles satisfy the relationship expressed by Expression 2-B:

$$-4E \leqq R1 \times R2 \leqq 7.5E \quad \text{Expression 2-B}$$

<6> The latent electrostatic image developing carrier according to any one of <1> to <5>, wherein each of the first fine conductive particles contains a tin oxide layer and a conductive coating layer provided thereon and made of an indium oxide layer containing tin dioxide, and each of the second fine conductive particles contains fine tin oxide conductive particles.

<7> The latent electrostatic image developing carrier according to <6>, wherein the second fine conductive particles are fine conductive powder containing neither antimony nor indium, or containing at least one of antimony and indium in an amount equal to or lower than the detection limit by at least thermal analysis.

<8> The latent electrostatic image developing carrier according to <6> or <7>, wherein the second fine conductive particles contain carbon on surfaces thereof.

<9> The latent electrostatic image developing carrier according to any one of <1> to <8>, wherein the particulate material is contained in the coating layer in such an amount that the coverage of the carrier core material with the particulate material is 30% to 90%.

<10> The latent electrostatic image developing carrier according to any one of <1> to <9>, wherein the latent electrostatic image developing carrier has a volume specific resistance of $1\times10^9$ Ω·cm to $1\times10^{17}$ Ω·cm.

<11> The latent electrostatic image developing carrier according to any one of <1> to <10>, wherein the coating layer has an average thickness of 0.05 μm to 4.00 μm.

<12> The latent electrostatic image developing carrier according to <11>, wherein the coating layer has an average thickness of 0.05 μm to 2.00 μm.

<13> The latent electrostatic image developing carrier according to any one of <1> to <12>, wherein the latent electrostatic image developing carrier has a weight average particle diameter of 20 μm to 65 μm.

<14> The latent electrostatic image developing carrier according to any one of <1> to <13>, wherein the resin contained in the coating layer contains a silicone resin.

<15> The latent electrostatic image developing carrier according to any one of <1> to <14>, wherein the resin contained in the coating layer contains an acrylic resin.

<16> The latent electrostatic image developing carrier according to any one of <1> to <15>, wherein the resin contained in the coating layer contains at least an acrylic resin and a silicone resin.

<17> The latent electrostatic image developing carrier according to any one of <1> to <16>, wherein the latent electrostatic image developing carrier has a magnetization of 40 $Am^2/kg$ to 90 $Am^2/kg$ at a magnetic field of 1 kOe.

<18> A two-component developer including:

a toner, and the latent electrostatic image developing carrier according to any one of <1> to <17>.

<19> The two-component developer according to <18>, wherein the toner is a color toner.

<20> A developer-containing container including:

a container, and the two-component developer according to <18> or <19>, which is contained in the container.

<21> An image forming method including:

forming an image with the two-component developer according to <18> or <19>.

<22> A process cartridge including:

a photoconductor, and a developing unit containing at least the two-component developer according to <18> or <19>, wherein at least the photoconductor and the developing unit are integrally supported.

The carrier of the present invention can be controlled in resistance in a wide range, involves no carrier adhesion, suppresses edge effects, provides good reproducibility of thin lines such as letters, and can form high-fineness images without color stains. In addition, the carrier stably changes in charge amount even when the amount of toner consumed is small. Furthermore, the carrier changes in charge amount and resistance to a small extent with increasing of the running and thereby overcoming failures such as toner scattering and uneven image density, and can maintain good image quality over a long period of time. Moreover, the carrier contains no antimony, and thus, has an excellent safety to human and environment, which is advantageous.

DETAILED DESCRIPTION OF THE INVENTION

Figure 1:
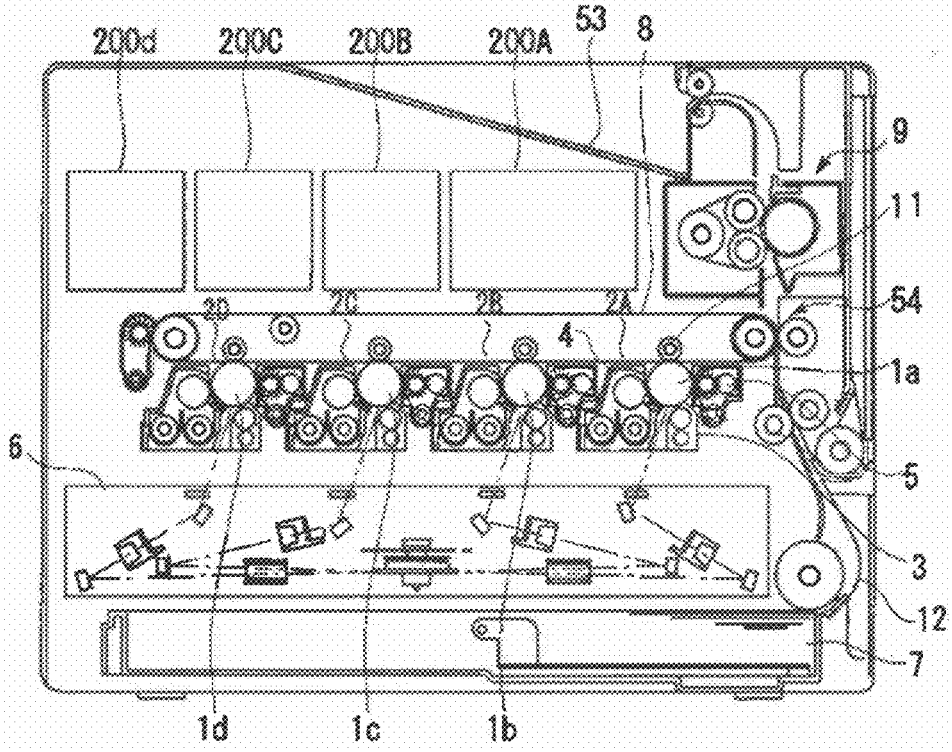
FIG. 1 illustrates one exemplary image forming apparatus containing process cartridges of the present invention.

Next, the present invention will be described in more detail.

The present inventors continued to study in order to solve the above-described existing problems pertinent in the art, and as a result have found that remarkably improved effects can be obtained from a latent electrostatic image developing carrier which includes a carrier core material and a coating layer containing a resin and provided on a surface of the carrier core material, wherein the coating layer includes a particulate material containing at least first fine conductive particles and second fine conductive particles, and wherein the first fine conductive particles and the second fine conductive particles satisfy the following relationship: $3 \leqq D1/D2 \leqq 15$, preferably $3 \leqq D1/D2 \leqq 10$, more preferably $7 \leqq D1/D2 \leqq 8$, where D1 denotes a dispersed particle diameter of the first fine conductive particles and D2 denotes a dispersed particle diameter of the second fine conductive particles.

Furthermore, when the first fine conductive particles and the second fine conductive particles satisfy the following relationship: $-7E \leqq R1 \times R2 \leqq 8E$, preferably $-5E \leqq R1 \times R2 \leqq 7.5E$, more preferably $-4E \leqq R1 \times R2 \leqq 7.5E$, where R1 denotes a powder specific resistance of the first fine conductive particles and R2 denotes a powder specific resistance of the second fine conductive particles, it has been found that remarkably improved effects can be obtained. This is likely because, by adjusting two different particles with different particle diameters and resistances to satisfy the above relationships, the formed carrier can be improved in resistance adjustability, anti-spent property (scraping performance) and carrier adhesion by virtue of uniform resistance on the carrier coat layer.

It has been found that use of two different particles having different resistances can improve uniformity in charging and suppress toner scattering although the reason is not clear.

In terms of resistance adjustability, the carrier can be increased as a result that the second fine conductive particles are embedded between the first fine conductive particles having a larger particle diameter. Especially when carbon black is used, particularly remarkably improved effects can be obtained. When the resistance of carbon black is adjusted without using any agent in a conventional manner, problematic stains of toner color arise depending on the amount added or abrasion of the coat layer of the carrier made of carbon sole. However, as in the present invention, when carbon black is used in combination with particles having a large particle diameter, color staining can be considerably improved, since the amount of carbon black added can be reduced and film abrasion can be suppressed due to filler effects of such large particles.

Regarding anti-spent property, when the carrier particles, containing large first fine conductive particles with concave and convex portions on the surfaces thereof, are brought into contact with one another, toner spent matter is mutually scraped off. Also, regarding uniform resistance, it is possible to prevent the carrier surfaces from having ununiform resistance by dispersing the small second fine conductive particles to a primary particle diameter or so. As a result, the state where the filler is attached between the carrier particles becomes uniform, whereby carrier adhesion can be improved.

Examples of the fine conductive particles having a small particle diameter include tin oxide. In general, tin oxide is coated with antimony to adjust a powder specific resistance thereof, exhibiting resistance adjusting effects. However, use of antimony is problematic in terms of safety to human and environment. In addition, tin oxide powder containing antimony assumes bluish color, causing the same problem as in carbon black; i.e., the color of the toner is impaired.

Further, when the first fine conductive particles contain a tin oxide layer and a conductive coating layer provided thereon and made of an indium oxide layer containing tin dioxide, and the second fine conductive particles contain fine tin oxide conductive particles, it has been found that remarkably improved effects can be obtained.

Also, remarkably improved effects can be obtained when the base of the first fine conductive particles is made of one or more selected from aluminum oxide, titanium dioxide, zinc oxide, silicon dioxide, barium sulfate and zirconium oxide.

Further, remarkably improved effects can be obtained when the second fine conductive particles are made of one or more selected from titanium oxide, tin oxide, carbon black, indium oxide and complexes thereof.

Moreover, remarkably improved effects can be obtained when the second fine conductive particles contain carbon on the surfaces thereof. For example, it is important that a trace amount of carbon is present on the surface of tin. Although it is not clear how the amount of carbon present on the surface is linked with the resistance of conductive tin oxide, when the amount of carbon present on the surface is too large, the resistance of conductive tin oxide becomes relatively unstable over time. Also, when carbon is included in toner due to, for example, abrasion of the carrier film, color staining is problematically caused similar to the case of carbon black. Thus, it is necessary that the amount of carbon present on the surface is very small. However, it has been found that, by using particles having a large particle diameter in combination, problematic color mixing can be improved.

From the viewpoint of, for example, improving image quality, it has conventionally been required that carrier particles are appropriately adjusted in resistance. For example, when the resistance of the carrier is sufficiently adjusted, the charge leak rate becomes low. As a result, the leak rate of countercharges generated on the carrier after development becomes low, and the carrier is degraded in charge-imparting property for new toner particles. Thus, non-charged toner particles tend to be generated, causing severe toner scattering on non-image portions. Alternatively, the countercharges generated after development allow the sleeve to have an image force, and the sleeve entrains agents which must be originally removed from the sleeve. The developer whose toner concentration has been decreased due to entrainment after development is mixed with a new developer whose toner has not yet been consumed, causing uneven toner concentration in the resultant developer. As a result, the image density considerably varies from place to place upon developing, in particular, an image with a high image density (e.g., a solid image). As described above, the carrier containing tin oxide has high resistance adjustability. In addition, since the charge leak rate is high, it has been found that the carrier has high charge-imparting property for new toner to effectively prevent toner scattering from occurring. Moreover, since entrainment by the sleeve after development does not occur, it has been found that uniform images with no unevenness in image density can be formed.

Figure 3:
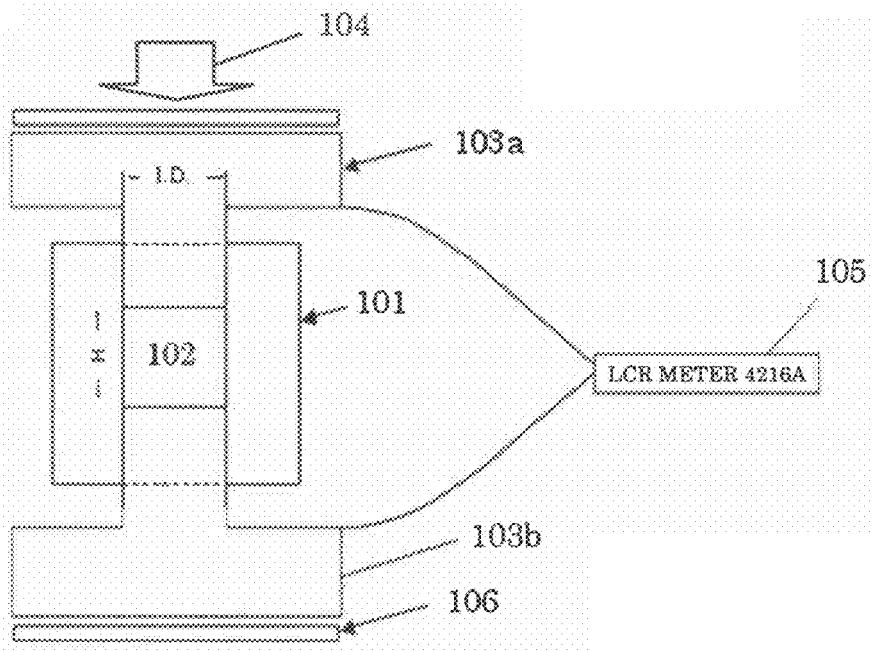
FIG. 3 illustrates an apparatus for measuring a powder specific resistance of fine conductive particles in the present invention.

In the present invention, the powder specific resistance of the fine conductive particles is measured in the following manner as shown in FIG. 3. First, 5 g of a sample 102 is placed in a cylindrical tube 101 made of vinyl chloride having an inner diameter (I.D.) of 1 inch (2.54 cm). The vinyl chloride tube is sandwiched with electrodes 103*a* and 103*b* at the upper portion and the lower portion thereof. Then, a pressure of 10 kg/cm$^2$ (indicated by arrow 104) is applied to the electrodes using an unillustrated pressing machine. Next, an inductance-capacitance-resistance (LCR) meter 105 (4216A, manufactured by YOKOGAWA HEWLETT PACKARD Inc.) is connected to the electrodes under a pressure of 10 kg/cm$^2$ to measure the resistance (r) (Ω). Then, the powder specific resistance of the conductive particles can be calculated by using the obtained resistance based on the following Equation A. Notably, in FIG. 3, reference numeral 106 denotes a plate made of Teflon (thickness: 2 mm).

$$\text{Powder Specific Resistance}(\Omega\cdot\text{cm})=(2.54/2)^2\times(\pi/H\times r) \qquad \text{Equation A}$$

In Equation A, H denotes the thickness of the sample, and r denotes the resistance obtained.

Furthermore, it is important to suitably treat the second fine conductive particles used in the present invention, since they have a small particle diameter. In general, it is difficult to disperse particles having a particle diameter of 500 nm or lower. As a result, the quality of the carrier may be varied when such small particles are not appropriately dispersed.

It is generally known that smaller particles aggregate to a higher extent. Thus, when dispersed by the same method as conventionally employed, the fine conductive particles used in the present invention are aggregated, so that they cannot be dispersed to a primary particle diameter or so. The carrier coating liquid containing aggregated fine conductive particles is degraded in uniformity and stability, problematically causing clogging of equipment during coating. Further, such a carrier coating liquid involves uneven adhesion onto the coat film. Uneven adhesion of fine conductive particles leads to unfavorable innercarrier properties; i.e., uneven surface resistance and charge characteristics, as well as unfavorable intercarrier properties; i.e., uneven resistance and charge characteristics between carriers. As a result of intercarrier or innercarrier variation in adhesion of fine conductive particles, some carriers have a locally low resistance. Such carriers adversely affect image quality upon printing of an image with a high image area (as solid carrier adhesion). Also, uneven adhesion of fine conductive particles causes uneven electrical characteristics on the carrier surface. The charge amount of toner tends to decrease depending on the coverage of the carrier with the toner. When the carrier is covered with the toner at high ratio, the charge amount of the toner is not sufficient, easily causing problems on image quality due to toner scattering. In view of this, it is important in the present invention that the second fine conductive particles are dispersed using media having a small particle diameter of 1 mm or less, instead of using a shearing force generated between gaps among beads having a diameter of several millimeters conventionally used.

Furthermore, when particles having a small particle diameter are dispersed, stability in charging can be obtained. That is, small particles are finely dispersed to form concave/convex portions in the carrier surface layer. In general, externally added particles are transferred from the toner to the carrier such that they are entrapped in the concave/convex portions of the carrier. In the present invention, the concave/convex portions are very small, and thus, externally added particles having a larger size than that of the concave/convex portions, especially large particles having a particle diameter of about 100 nm, can be prevented from being transferred. As a result, the charge amount of the carrier can be stable over time.

In the present invention, the "dispersed particle diameter" is a value obtained by measuring one type of particles for particle diameter. This is because a coating liquid containing two or more different particles is difficult to measure for particle diameter.

That is, in Examples, in the case of a mixture of a coating resin and two different particles; i.e., particle A and particle B, the dispersed particle diameters of particle A and particle B were individually measured as follows. Specifically, either particle A or particle B was dispersed in the coating resin with a dispersing unit described in Examples, and the resultant dispersed mixture is measured for particle diameter.

The particle diameter was measured with LA-950V2 (product of HORIBA). The refractive index was adjusted by appropriately selecting a solvent used and by controlling particles.

The fine conductive powder used as the second fine conductive particles is not particularly limited and may be appropriately selected depending on the intended purpose. The amounts of antimony and indium contained in the fine conductive powder are preferably at least equal to or lower than the detection limit by thermal analysis.

The carrier preferably has a volume specific resistance of $1\times10^{9}$ Ω·cm to $1\times10^{17}$ Ω·cm.

The carrier preferably has a weight average particle diameter of 20 μm to 65 μm. Also, the carrier preferably contains a silicone resin. Also, the carrier preferably has an acrylic resin. Also, a binder resin (a resin contained in the coating layer) preferably contains at least an acrylic resin and a silicone resin.

Further, the carrier preferably has a magnetization of 40 $Am^2$/kg to 90 $Am^2$/kg at a magnetic field of 1 kOe.

The amount of the particulate material contained in the resin coating layer is not particularly limited and may be appropriately determined depending on the intended purpose. Preferably, the particulate material is contained in the resin coating layer in such an amount that the coverage of the carrier core material with the particulate material is 30% to 90%.

The average thickness of the resin coating layer is not particularly limited and may be appropriately determined depending on the intended purpose. The average thickness is preferably 0.05 μm to 4.00 μm, more preferably 0.05 μm to 2.00 μm.

As the toner production method, the methods known in the art such as pulverizing method, and polymerization method may be employed. For example, in the toner pulverizing method, a device for kneading the toner materials is not particularly limited. Examples thereof include a batch type kneader using two rolls; a Banbary mixer; biaxial-consecutive kneaders such as a KTK type biaxial extruder (manufactured by KOBE STEEL, LTD.); a TEM type biaxial extruder (manufactured by TOSHIBA MACHINE CO., LTD.), a biaxial extruder (manufactured by KCK); a PCM type biaxial extruder (manufactured by IKEGAI, LTD.), and a KEX type biaxial extruder (manufactured by Kurimoto Ltd.); and uniaxial consecutive kneaders such as a co-kneader (manufactured by BUSS Inc.), etc.

The melted and kneaded material obtained using the above method is cooled and pulverized. The obtained material is coarsely pulverized by using, for example, a hummer mill, Rotoplex, or the like. Further, pulverizers using a jet stream, mechanical pulverizers or the like can also be used for the pulverizing.

Preferably, the toner material is pulverized so as to have an average particle diameter of 3 μm to 15 μm. Further, the pulverized material is preferably classified by a wind-force type classifier so as to have a diameter of 5 μm to 20 μm. Next, in the process of externally adding external additives to the toner base, the external additives are applied onto the toner surface while being fused and broken by mixing the toner base and the external additives using a mixer and the like, and stirring them. At that time, it is important to make the external additives such as fine inorganic particles and the fine resin particles uniformly and solidly adhered on the surface of the toner base in terms of durability. It should be understood that the above description is only one example and not construed as being limited thereto.

Moreover, when the carrier of the present invention is combined with a toner containing at least a binder resin and a colorant to form a latent electrostatic image bearing developer, remarkably improved effects can be obtained. The carrier of the present invention can provide a high-fineness image and has a long service life. Thus, the developer containing the carrier of the present invention can provide excellent image quality. In particular, when used in combination with the toner further containing a releasing agent, the carrier of the present invention is preferably used since it has a long service life.

Furthermore, remarkably improved effects can be obtained when the toner used is a color toner. This is because the carrier of the present invention does not contain carbon black in the coating layer, and smears of images caused by carbon black associated with film abrasion do not occur. Thus, the carrier is extremely suitable to a color developer of which color reproducibility is emphasized. The color toner said herein means not only color toners which are typically used in monochrome color but also color toners which are used as a full-color toner such as yellow toner, magenta toner, cyan toner, red toner, green toner, and blue toner.

The toner of the present invention will be specifically described hereinbelow. The toner includes all the generally used toners, regardless of the type of monochrome toner, color toner, or full-color toner. For example, it includes kneaded and crushed type toners which are conventionally used, and a variety of polymerized toners which have been increasingly used in recent years. Further, so-called oil-less toners in which a releasing agent is included can also be used. Since an oil-less toner typically contains a releasing agent, a so-called spent, which is a phenomenon that the releasing agent transfers to the carrier surface, easily occur, however, the carrier of the present invention can keep the excellent quality for a long period of time because it excels in anti-spent property. Particularly, in an oil-less full-color toner, it is generally said that it is easily liable to go through a spent, because a binder resin used therein is soft, however, it can be said that the carrier of the present invention is extremely suitable for oil-less full-color toners.

Further, color toners, in particular, generally, yellow toners have a shortcoming that color contamination occurs due to abrasion of the coating layer of carrier. However, the carrier of the present invention excels in that the occurrence of color contamination less influences even though the coating layer is abraded and attached to toner particles. The developer of the present invention can prevent the occurrence of color contamination.

The binder resin contained in the toner used in the present invention is not particularly limited and may be suitably selected from those known in the art in accordance with the intended use. Examples of the binder resin include styrenes such as polystyrenes, poly-p-styrenes, and polyvinyl toluenes or monopolymers of substitution thereof; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene methacrylate copolymers. Styrene-methyl methacrylate copolymers, styrene-ethyl methacrylate copolymers, styrene-butyl methacrylate copolymers, styrene-α-methyl chloromethacrylate copolymer, styrene-acrylonitrile copolymers, styrene-vinylmethyl-ether copolymers, styrene-vinylmethyl-keton copolymers, styrene-butadiene copolymers, styrene-isopropyl copolymers, and styrene-maleic acid ester copolymers; polymethyl methacrylates, polybutyl methacrylates, polyvinyl chlorides, polyvinyl acetates, polyethylenes, polyesters, polyurethanes, epoxy resins, polyvinyl butyrals, polyacrylic resins, rosins, modified rosins, terpene resins, phenol resins, aliphatic hydrocarbon resins, aromatic hydrocarbon resins, and aromatic petroleum resins. These may be used alone or in combination.

The binder resin for pressure-fixing is not particularly limited and may be suitably selected from those known in the art. Examples thereof include polyolefins such as low-molecular weight polyethylenes, and low-molecular weight polypropylenes; olefin copolymers such as ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer, and ionomer resin; epoxy resins, polyester, styrene-butadiene copolymers, polyvinyl pyrrolidone, methylvinylether-maleic anhydride copolymer, maleic acid-modified phenol resins, and phenol-modified terpene resins. These may be used alone or in combination.

As colorants used in the toners such as color toners, it is possible to use all the pigments and dyes known in the art by which individual color toners of yellow, magenta, cyan, and black can be obtained. The colorants are not limited to those described in the present invention.

Examples of yellow pigments include, but are not limited to, cadmium yellow, mineral fast yellow, nickel titan yellow, navel yellow, naphthol yellow S, hansa yellow G, hansa yellow 10G benzidine yellow GR, quinoline yellow Lake, permanent yellow NCG, tartrazine lake.

Examples of orange color pigments include molybdenum orange, permanent orange GTR, pyrazolone orange, vulcan orange, indanthrene brilliant orange RK, benzidine orange G, and indanthrene brilliant orange GK.

Examples of red pigments include colcothar, cadmium red, permanent red 4R, lithol red, pyrazolone red, washing red calcium salt, lake red D, brilliant carmine 6B, eosin lake, rhodamine lake B, alizarin lake, and brilliant carmine 3B.

Examples of violet pigments include fast violet B, and methyl violet lake.

Examples of blue pigments include cobalt blue, alkali blue lake, Victoria blue lake, phthalocyanine blue, metal-free phthalocyanine blue, phthalocyanine blue part-chlorinated pigments, fast sky blue, and indanthrene blue BC.

Examples of green pigments include chrome green, chromium oxide, pigment green B, and malachite green lake.

Examples of black pigments include azine dyes such as carbon black, oil farness black, channel black, lamp black, acetylene black, aniline black; metal salt azo dyes, metal oxides, and composite metal oxides.

These may be used alone or in combination.

Further, besides the binder resins and the colorants, a fixing auxiliary agent can be included in the toner used in the present invention. By including the fixing auxiliary agent, it is also possible to use the toner in fixing systems, so-called oil-less system in which oil for preventing toner fixation is not applied to a fixing roll. As the fixing auxiliary agent, those known in the art can be used. For example, it is possible to use polyolefins such as polyethylenes, and polypropylenes; fatty acids of metal salts, fatty acid esters, paraffin waxes, amide waxes, polyvalent alcohol waxes, silicone varnishes, carnauba waxes, and ester waxes, and the fixing auxiliary agents are not limited to those stated above.

In the toner used in the present invention such as color toners, a charge controlling agent can be included in accordance with the intended use. Examples of the charge controlling agent include nigrosine, azine dyes containing an alkyl group having carbon atoms of 2 to 16 (Japanese Patent Application Publication (JP-B) No. 42-1627), basic dyes such as C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), and C. I. Basic Green 4 (C. I. 42000), lake pigments of basic dyes thereof, C. I. Solvent Black 8 (C. I. 26150); quaternary ammonium salts such as benzoilmethylhexadecyl ammonium chloride, decyltrimethyl chloride; or dialkyltin compounds such as dibutyl or dioctyl; dialkyltin borate compounds; guanidine derivatives; vinylpolymers containing an amino group; polyamine resins such as condensation polymers containing an amino group; metallic complex salts of monoazo dyes disclosed in Japanese Patent Application Publication (JP-B) Nos. 41-20153, 43-27596, 44-6397, and 45-26478; metallic complexes of salicylic acids, dialkyl salicylic acids, naphthoic acids, dicarboxylic acids with Zn, Al, Co, Cr, Fe, or the like which are disclosed in Japanese Patent Application Publication (JP-B) Nos. 55-42752, and 59-7385; sulfonated copper phthalocyanine pigments; organic boron salts; quaternary fluorine-containing ammonium salts; and calyx allene compounds. In color toners other than black toner, a charge controlling agent that impairs the intended colors should not be used, and white-color metallic salts of salicylic acid derivatives or the like are preferably used.

With respect to external additives used in the toner, the transferring property and durability of the toner are further improved by externally adding fine inorganic particles and fine resin particles of silicas, titanium oxides, aluminas, silicon carbides, silicon nitrides, boron nitrides or the like in the toner base particles. The effect of further improving the transferring property and durability of toner can be obtained by covering over a wax or waxes which may degrade the transferring property and durability of the toner with these external additives and by making the toner surface covered with fine particles to reduce the contact surface area of the toner. It is preferred that these fine inorganic particles have their surfaces hydrophobized, and fine metal oxide particles such as silica and titanium oxide having their surfaces hydrophobized are preferably used.

For the fine resin particles, fine polymethyl methacrylate particles and/or fine polystyrene particles having an average particle diameter 0.05 μm to 1 μm which are obtained by a soap-free emulsion polymerization are preferably used. Further, by using silica which have been hydrophobized in combination with titanium oxide which have been hydrophobized, in which the additive amount of the hydrophobized titanium oxide is larger than that of the hydrophobized silica, a toner excellent in charge stability to humidity can be obtained.

A developer-containing container of the present invention includes at least a container and the two-component developer of the present invention.

The developer of the present invention can be used in, for example, an image forming apparatus containing a process cartridge illustrated in FIG. 1. An image forming method of the present invention includes forming an image with the developer of the present invention using, for example, the above image forming apparatus.

In the present invention, several constituent members (e.g., a photoconductor, a charging unit, a developing unit and a cleaning unit) are integrally formed into a process cartridge. The process cartridge is detachably mounted to the main body of an image forming apparatus such as a copier or printer.

Each process cartridge (2A, 2B, 2C or 2D) illustrated in FIG. 1 includes a photoconductor (1A, 1B, 1C or 1D), a charging unit (3), a developing unit (4) and a cleaning unit (5). The photoconductor (1A, 1B, 1C or 1D) is rotated at a predetermined circumferential speed. While being rotated, the photoconductor (1A, 1B, 1C or 1D) is positively or negatively charged by the charging unit (2A, 2B, 2C or 2D) so as to have a predetermined uniform charge on the surface thereof. Next, the thus-charged photoconductor is exposed imagewise to light emitted from an image-exposing unit (6) (e.g., slit exposure or laser beam scanning exposure), whereby a latent electrostatic image is formed on the surface of the photoconductor (1A, 1B, 1C or 1D). The thus-formed latent electrostatic image is developed with a toner by the developing unit (4). The thus-developed toner image is transferred onto a belt-like intermediate transfer member (8) by a primary transfer unit (11). Then, the thus-transferred image is further transferred by a secondary transfer unit (54) onto a recording medium (12) which has been fed from a paper-feeding portion (7) between the intermediate transfer member (8) and the secondary transfer unit (54) in synchronization with the rotation of the photoconductor (1A, 1B, 1C or 1D). The recording medium (12), onto which the image has been transferred, is separated from the surface of the intermediate transfer member (8) and then introduced into an image fixing unit (9) where the image is fixed. After that, the recording medium is output as a copied product to a tray (53) outside the apparatus. The residual toner particles are removed (cleaned) by the cleaning unit (9) from the surface of the photoconductor (1A, 1B, 1C or 1D) having undergone image transfer. Furthermore, the photoconductor surface is charge-eliminated and then repeatedly used for image formation.

EXAMPLES

The present invention will next be described in more detail by way of Examples and Comparative Examples, but should not be construed as being limited to Examples. Note that the unit "part(s)" is on the mass basis (i.e., part(s) by mass).

Fine Conductive Particles

Production Example 1

First Fine Conductive Particles A

First, 200 g of aluminum oxide (average primary particle diameter of 0.40 μm, and absolute specific gravity of 3.9) was dispersed in 2.5 L of water to prepare an aqueous suspension liquid. The suspension liquid was heated to and kept at 80° C. Separately, 25 g of stannic chloride ($SnCl_4.5H_2O$) was dissolved in 200 mL of 2N hydrochloric acid. The thus-prepared solution and 12% by mass aqueous ammonia were added to the above-prepared suspension liquid so that the pH of the suspension liquid was kept at 7 to 8. Separately, 75 g of indium chloride ($InCl_3$) and 10 g of stannic chloride ($SnCl_4.5H_2O$) were dissolved in 800 mL of 2N hydrochloric acid. The thus-prepared solution and a 12% by mass aqueous ammonia were added dropwise to the resultant suspension liquid so that the pH of the suspension liquid was kept at 7 to 8. After completion of the dropwise addition, the thus-treated suspension liquid was filtrated and washed, and the obtained cake of pigment was dried at 120° C.

Next, the obtained dry powder was heated at 500° C. for 1.5 hours under a stream of nitrogen gas (1 L/minute). The thus-obtained fired product was pulverized and then charged into a HENSCHEL MIXER heated to 70° C. Next, 3.5% by mass γ-aminopropyl triethoxysilane was mixed under stirring with the pulverized product in the mixer. Further, the thus-treated product was heated at 100° C. for 1 hour, to thereby obtain white conductive powder A of interest (first fine conductive particles A).

Production Example 2

First Fine Conductive Particles B

First, 200 g of aluminum oxide (average primary particle diameter of 0.40 μm, and absolute specific gravity of 3.9) was dispersed in 2.5 L of water to prepare an aqueous suspension liquid. The suspension liquid was heated to and kept at 80° C. Separately, 25 g of stannic chloride ($SnCl_4.5H_2O$) was dissolved in 200 mL of 2N hydrochloric acid. The thus-prepared solution and 12% by mass aqueous ammonia were added to the above-prepared suspension liquid so that the pH of the suspension liquid was kept at 7 to 8. Separately, 55 g of indium chloride ($InCl_3$) and 7 g of stannic chloride ($SnCl_4.5H_2O$) were dissolved in 800 mL of 2N hydrochloric acid. The thus-prepared solution and a 12% by mass aqueous ammonia were added dropwise to the resultant suspension liquid so that the pH of the suspension liquid was kept at 7 to 8. After completion of the dropwise addition, the thus-treated suspension liquid was filtrated and washed, and the obtained cake of pigment was dried at 120° C.

Next, the obtained dry powder was heated at 500° C. for 1.5 hours under a stream of nitrogen gas (1 L/minute). The thus-obtained fired product was pulverized and then charged into a HENSCHEL MIXER heated to 70° C. Next, 3.5% by mass γ-aminopropyl triethoxysilane was mixed under stirring with the pulverized product in the mixer. Further, the thus-treated product was heated at 100° C. for 1 hour, to thereby obtain white conductive powder B of interest (first fine conductive particles B).

Production Example 3

First Fine Conductive Particles C

First, 200 g of aluminum oxide (average primary particle diameter of 0.25 μm, and absolute specific gravity of 3.9) was dispersed in 2.5 L of water to prepare an aqueous suspension liquid. The suspension liquid was heated to and kept at 80° C. Separately, 25 g of stannic chloride ($SnCl_4.5H_2O$) was dissolved in 200 mL of 2N hydrochloric acid. The thus-prepared solution and 12% by mass aqueous ammonia were added to the above-prepared suspension liquid so that the pH of the suspension liquid was kept at 7 to 8. Separately, 55 g of indium chloride ($InCl_3$) and 7 g of stannic chloride ($SnCl_4.5H_2O$) were dissolved in 800 mL of 2N hydrochloric acid. The thus-prepared solution and a 12% by mass aqueous ammonia were added dropwise to the resultant suspension liquid so that the pH of the suspension liquid was kept at 7 to 8. After completion of the dropwise addition, the thus-treated suspension liquid was filtrated and washed, and the obtained cake of pigment was dried at 120° C.

Next, the obtained dry powder was heated at 500° C. for 1.5 hours under a stream of nitrogen gas (1 L/minute). The thus-obtained fired product was pulverized and then charged into a HENSCHEL MIXER heated to 70° C. Next, 3.5% by mass γ-aminopropyl triethoxysilane was mixed under stirring with the pulverized product in the mixer. Further, the thus-treated product was heated at 100° C. for 1 hour, to thereby obtain white conductive powder C of interest (first fine conductive particles C).

Production Example 4

First Fine Conductive Particles D

Aluminum oxide (average primary particle diameter of 0.40 μm, and absolute specific gravity of 3.9) was used as white conductive powder D (first fine conductive particles D).

Second Fine Conductive Particles

Production Example 5

Second Fine Conductive Particles 1

Fine tin oxide powder having a BET surface area of 5 $m^2/g$ (primary particle diameter: 500 nm) was immersed in ethanol and then heated in a nitrogen atmosphere. The fine powder was maintained at 250° C. for 1 hour for surface treatment, to thereby obtain second fine conductive particles 1.

Production Example 6

Second Fine Conductive Particles 2

Fine tin oxide powder having a BET surface area of 15 $m^2/g$ (primary particle diameter: 200 nm) was immersed in ethanol and then heated in a nitrogen atmosphere. The fine powder was maintained at 250° C. for 1 hour for surface treatment, to thereby obtain second fine conductive particles 2.

Production Example 7

Second Fine Conductive Particles 3

Fine tin oxide powder having a BET surface area of 50 $m^2/g$ (primary particle diameter: 50 nm) was heated in a nitrogen atmosphere while being exposed to acetone gas. The fine powder was maintained at 300° C. for 2 hours for surface treatment, to thereby obtain second fine conductive particles 3.

Production Example 8

Second Fine Conductive Particles 4

Fine tin oxide powder having a BET surface area of 50 $m^2/g$ (primary particle diameter: 50 nm) was used as second fine conductive particles 4.

Production Example 9

Second Fine Conductive Particles 5

Fine tin oxide powder having a BET surface area of 50 $m^2/g$ (primary particle diameter: 50 nm) was treated with ATO, and the treated fine powder was used as second fine conductive particles 5.

Production Example 10

Second Fine Conductive Particles 6

Fine carbon black powder having a BET surface area of 1,500 $m^2/g$ (primary particle diameter: 12 nm) was used as second fine conductive particles 6.

Production Example 11

Second Fine Conductive Particles 7

Fine tin oxide powder having a BET surface area of 50 $m^2/g$ (Bastran TYPE-VI (product of MITSUI MINING & SMELTING CO., LTD.), primary particle diameter: 20 nm) was used as second fine conductive particles 7.

Production Example 12

Second Fine Conductive Particles 8

Fine titanium oxide powder having a BET surface area of 70 $m^2/g$ (MT-150A (product of TAYCA Co.), primary particle diameter: 15 nm) was used as second fine conductive particles 8.

Also, the amount of carbon contained in the fine conductive particles can be quantified by a high-frequency combustion-infrared absorption method (model IR-412, product of LECO CO.).

Table 1 shows powder specific resistances and dispersed particle diameters of first fine conductive particles A to D and second fine conductive particles 1 to 8.

TABLE 1

| Type | Powder specific resistance Log(Ω · cm) | Dispersed particle diameter μm |
|---|---|---|
| First fine conductive particles A | 0.5 | 400 |
| First fine conductive particles B | 2 | 400 |
| First fine conductive particles C | 2 | 250 |
| First fine conductive particles D | 5 | 400 |
| Second fine conductive particles 1 | 3 | 500 |
| Second fine conductive particles 2 | 2.5 | 200 |
| Second fine conductive particles 3 | 1.5 | 50 |
| Second fine conductive particles 4 | 7 | 50 |
| Second fine conductive particles 5 | 4 | 50 |
| Second fine conductive particles 6 | −1.8 | 20 |
| Second fine conductive particles 7 | 0.3 | 20 |
| Second fine conductive particles 8 | 4.17 | 15 |

Example 1

Production of Carrier

[Carrier 1]

The following components were dispersed for 10 minutes using a homomixer to prepare a resin coating film-forming solution.

Acrylic resin solution (solid content: 50% by mass): 138.95 parts

Guanamine solution (solid content: 70% by mass): 43.4 parts

Acid catalyst (solid content: 40% by mass): 0.77 parts

Silicone resin solution: 650.3 parts

[solid content: 20% by mss (SR2410, manufactured by TORAY DOW CORNING SILICONE CO., LTD.)]

Aminosilane: 0.8 parts

[solid content: 100% by mass (SH6020, manufactured by TORAY DOW CORNING SILICONE CO., LTD.)]

First fine conductive particles: fine conductive particles A: 231.7 parts

Second fine conductive particles: second fine conductive particles 1: 231.7 parts Toluene: 2,800 parts Separately, fired ferrite powder having a volume average particle diameter of 35 μm was provided as core materials. The above-prepared coating film-forming solution was applied onto the surfaces of the core materials so as to have a thickness of 1.0 μm using Spiracoater (manufactured by Okada Seiko K.K.) whose internal temperature had been set to 40° C., followed by drying. The obtained carrier was left to stand in an electric furnace at 300° C. for 1 hour for firing. After cooling, the ferrite bulk powder was sieved through a 63 μm-mesh sieve, to thereby prepare [Carrier 1] having a volume specific resistance of 11.0 Log (Ω·cm) and a magnetization of 68 $Am^2/kg$. Ratios D1/D2 and log (R1×R2) of [Carrier 1] are shown in Tables 2-1 and 2-2.

<Production of Toner>

[Toner 1]

The following materials were mixed together in a HENSCHEL MIXER and melt-kneaded using two-rollers at 120° C. for 40 minutes. Binder resin: polyester resin: 100 parts Number average molecular weight (Mn): 3,800

Weight average molecular weight (Mw): 20,000

Glass transition temperature (Tg): 60° C.

Softening point: 122° C.

Colorant: azo yellow pigment: 5 parts

C.I.P.Y. 180

Charge controlling agent: zinc salicylate: 2 parts

Releasing agent: carnauba wax: 3 parts

Melting point: 82° C.

After cooling, the kneaded product was coarsely pulverized with a hammer mill, and then finely pulverized with an air-jet pulverizer. The obtained fine powder was classified to thereby prepare toner base particles having a weight average particle diameter of 5 μm. Further, 1 part of silica, whose surface had undergone hydrophobidizing treatment, and 1 part of titanium oxide 1, which had been produced by a wet method, were added to 100 parts of the toner base particles, followed by mixing with a HENSCHEL MIXER, to thereby obtain [Toner 1] (yellow toner).

Next, 7 parts of [Toner 1] and 93 parts of [Carrier 1] were mixed and stirred together to prepare developer 1 with a toner concentration of 7% by mass. The obtained developer was evaluated for resistance adjustability, edge effect, image fineness, durability (reduced amount of charge, change in resistance, and carrier adhesion) and color staining. The results are shown in Table 3.

In the present invention, the powder specific resistance of the fine conductive particles was measured in the following manner as shown in FIG. 3. First, 5 g of a sample 102 was placed in a cylindrical tube 101 made of vinyl chloride having an inner diameter (I.D.) of 1 inch (2.54 cm). The vinyl chloride tube was sandwiched with electrodes 103*a* and 103*b* at the upper portion and the lower portion thereof. Then, a pressure of 10 $kg/cm^2$ (indicated by arrow 104) was applied to the electrodes using an unillustrated pressing machine. Next, an inductance-capacitance-resistance (LCR) meter 105 (4216A, manufactured by YOKOGAWA HEWLETT PACKARD Inc.) was connected to the electrodes under a pressure of 10 $kg/cm^2$ to measure the resistance (r) (a). Then, the powder specific resistance of the conductive particles was calculated by using the obtained resistance based on the following Equation A. Notably, in FIG. 3, reference numeral 106 denotes a plate made of Teflon (thickness: 2 mm).

$$\text{Powder Specific Resistance}(\Omega\cdot\text{cm})=(2.54/2)^2\times(\pi/H\times r) \qquad \text{Equation A}$$

In Equation A, H denotes the thickness of the sample, and r denotes the resistance obtained.

Figure 2:
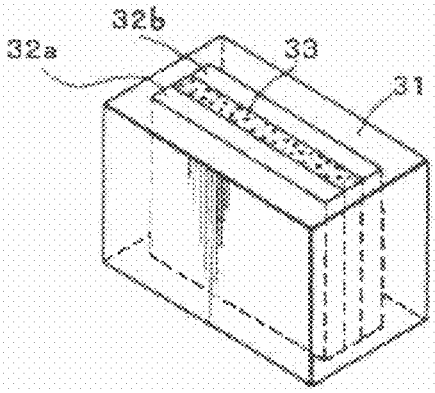
FIG. 2 illustrates an apparatus for measuring a volume specific resistance of a carrier in the present invention.

Here, the volume specific resistance in the present invention is determined as follows. Specifically, as shown in FIG. 2, carrier particles 33 are charged into a fluorine-resin cell 31 having 2.5 cm×4 cm electrodes 32*a* and 32*b* which are disposed 0.2 cm apart; the cell is tapped under the following conditions: fall height: 1 cm, tapping speed: 30 times/min, and the number of tappings: 10; a DC voltage of 1,000 V is applied between the electrodes; a resistance obtained after 30 sec from application of the DC voltage is measured with the high resistance meter 4329A (product of YOKOGAWA HEWLETT PACKARD Inc.); and the obtained resistance r is used to calculate a volume specific resistance R according to the following equation:

$$R=\text{Log}[r\times(2.5\text{ cm}\times4\text{ cm})\div0.2\text{ cm}]\ \text{〔Log}(\Omega\cdot\text{cm})\text{〕}$$

Next will be described evaluation methods and conditions thereof in Examples.

Magnetization (magnetic moment) of the carrier was measured as follows using VSM-P7-15 manufactured by TOEI INDUSTRY CO., LTD.

Specifically, about 0.15 g of a measurement sample was weighed and charged into a cell having an inner diameter of 2.4 mm and a height of 8.5 mm. Then, the sample was measured for magnetization at a magnetic field of 1,000 oersted (Oe).

<Carrier Adhesion>

The developer was set in a modified full-color printer of a commercially available digital full-color printer (IPSiO CX8200, product of Ricoh Company, Ltd.), and the modified full-color printer was caused to print out 100,000 monochrome images. Next, the background potential of the modified full-color printer was fixed at 150 V, and then the modified full-color printer was caused to print out a non-image chart. Thereafter, carriers adhering to the photoconductor surface were visually counted with a loupe at 5 different sites, and the obtained numbers were averaged. Further, the average was reduced to a value per 100 $cm^2$, which was regarded as the carrier adhesion amount.

The evaluation thereof was performed the following criteria: Average≦20: A; 21≦Average≦60: B; 61≦Average≦80: C; and 81≦Average: D, wherein A, B or C was regarded as "acceptable" and D as "rejection."

<Edge Effect>

The developer was set in a modified full-color printer of a commercially available digital full-color printer (IPSiO CX8200, manufactured by Ricoh Co., Ltd.), and the modified full-color printer was caused to output a test pattern having a large image area. Regarding the printed image, the difference in image density between the center portion and the edge portions was evaluated according to the following criteria: A: No difference observed; B: Slight difference observed; C: Difference observed, but acceptable level; and D: Difference observed, and unacceptable level, wherein A, B or C was regarded as "acceptable" and D as "rejection."

<Image Fineness>

Image fineness was evaluated based on the reproducibility of letter-image portions. Specifically, the developer was set in a modified full-color printer of a commercially available digital full-color printer (IPSiO CX8200, manufactured by Ricoh Co., Ltd.), and the modified full-color printer was caused to output a letter chart having an image area ratio of 5% (size of one letter: approx. 2 mm×approx. 2 mm). The obtained image was evaluated for reproducibility of the letter according to the following criteria: A: Excellent; B: Good; C: Acceptable; and D: Practically unacceptable, wherein A, B or C was regarded as "acceptable" and D as "rejection."

<Durability>

The developer was set in a modified full-color printer of a commercially available digital full-color printer (IPSiO CX8200, manufactured by Ricoh Co., Ltd.). The modified full-color printer was caused to print out 100,000 monochrome images. The durability was evaluated based on the reduced amount of charge in carrier and the change in resistance after completion of this running.

Here, the reduced amount of charge is determined as follows. Specifically, 93% by mass of an initial carrier is mixed with 7% by mass of a toner, and the resultant mixture is frictionally charged. The charged amount (Q1) of the frictionally charged sample is measured by means of a typically used blow-off apparatus (TB-200, manufactured by Toshiba Chemical Corp.). The toner contained in the developer that has gone through the running was removed using the blow-off apparatus to obtain a carrier, and the charged amount (Q2) of the thus-obtained carrier was measured in the same manner as in the charged amount (Q1). Then, the reduced amount in charge of the carrier is calculated by subtracting the charged amount (Q2) from the charged amount (Q1). The target value of the reduced amount of charge is within 10.0 (μc/g)'. Since the reduction in charge is caused as a result of toner-spent onto the carrier surface, the reduction in charge can be suppressed by reducing the toner-spent.

The change in resistance is determined as follows. Specifically, an initial carrier is placed in between parallel electrodes for resistance measurement disposed with a gap of 2 mm, a voltage of DC 1,000 V is applied to the electrodes, 30 seconds later of the application, the resistance of the carrier is measured using a high-resist meter, and the resistance is then converted into a volume resistance (R1). The toner contained in the developer that has gone through the running is removed using the blow-off apparatus to obtain a carrier. The volume resistance (R2) of the carrier is measured by the same method. The change in resistance is calculated by subtracting the volume resistance (R2) from the volume resistance (R1). The target value of the change in resistance is within 3.0 [Log (Ω·cm)] in absolute value. The reduced amount of change is caused by abrasion of the binder resin layer of the carrier, spent of toner components, and exfoliation of large particles in the carrier coating layer, therefore, the change in resistance can be suppressed by reducing them.

Example 2

The procedure of Example 1 was repeated, except that a resin coating film-forming solution was prepared through dispersion for 10 minutes using a vibration-type disperser or beads mill and Zr media instead of using the homomixer, to thereby obtain carrier 2 and developer 2.

Example 3

The procedure of Example 2 was repeated, except that the dispersion time was changed to 1 hour, to thereby prepare carrier 3 and developer 3.

Example 4

The procedure of Example 1 was repeated, except that the second fine conductive particles were changed to second fine conductive particles 3 (note that the first fine conductive particles were not changed), to thereby prepare carrier 4 and developer 4.

Example 5

The procedure of Example 4 was repeated, except that a resin coating film-forming solution was prepared through dispersion for 10 minutes using a vibration-type disperser or beads mill and Zr media instead of using the homomixer, to thereby obtain carrier 5 and developer 5.

Example 6

The procedure of Example 5 was repeated, except that the dispersion time was changed to 1 hour, to thereby prepare carrier 6 and developer 6.

Example 7

The procedure of Example 1 was repeated, except that the first fine conductive particles were changed to fine conductive particles B and the second fine conductive particles were changed to second fine conductive particles 6, to thereby prepare carrier 7 and developer 7.

Example 8

The procedure of Example 7 was repeated, except that a resin coating film-forming solution was prepared through dispersion for 10 minutes using a vibration-type disperser or beads mill and Zr media instead of using the homomixer, to thereby obtain carrier 8 and developer 8.

Example 9

The procedure of Example 8 was repeated, except that the dispersion time was changed to 1 hour, to thereby prepare carrier 9 and developer 9.

Example 10

The procedure of Example 1 was repeated, except that the first fine conductive particles were changed to fine conductive particles C and the second fine conductive particles were changed to second fine conductive particles 2, to thereby prepare carrier 10 and developer 10.

Example 11

The procedure of Example 10 was repeated, except that a resin coating film-forming solution was prepared through dispersion for 10 minutes using a vibration-type disperser or beads mill and Zr media instead of using the homomixer, to thereby obtain carrier 11 and developer 11.

Example 12

The procedure of Example 11 was repeated, except that the dispersion time was changed to 1 hour, to thereby prepare carrier 12 and developer 12.

Example 13

The procedure of Example 6 was repeated, except that the first fine conductive particles were changed to fine conductive particles D, to thereby prepare carrier 13 and developer 13.

Example 14

The procedure of Example 6 was repeated, except that a resin coating film-forming solution was prepared from the following components, to thereby prepare carrier 14 and developer 14.

Acrylic resin solution (solid content: 50% by mass): 69.475 parts
Guanamine solution (solid content: 70% by mass): 21.7 parts
Acid catalyst (solid content: 40% by mass): 0.39 parts
Silicone resin solution: 325.15 parts
[solid content: 20% by mss (SR2410, manufactured by TORAY DOW CORNING SILICONE CO., LTD.)]
Aminosilane: 0.4 parts
[solid content: 100% by mass (SH6020, manufactured by TORAY DOW CORNING SILICONE CO., LTD.)]
First fine conductive particles: fine conductive particles A: 115.9 parts
Second fine conductive particles: second fine conductive particles 1: 115.9 parts
Toluene: 1,400 parts Example 15

The procedure of Example 6 was repeated, except that a resin coating film-forming solution was prepared from the following components, to thereby prepare carrier 15 and developer 15.

Acrylic resin solution (solid content: 50% by mass): 13.2 parts
Guanamine solution (solid content: 70% by mass): 4.1 parts
Acid catalyst (solid content: 40% by mass): 0.07 parts
Silicone resin solution: 61.9 parts
[solid content: 20% by mss (SR2410, manufactured by TORAY DOW CORNING SILICONE CO., LTD.)]
Aminosilane: 0.1 parts
[solid content: 100% by mass (SH6020, manufactured by TORAY DOW CORNING SILICONE CO., LTD.)]
First fine conductive particles: fine conductive particles A: 22.1 parts
Second fine conductive particles: second fine conductive particles 1: 22.1 parts
Toluene: 267 parts Comparative Example 1

The procedure of Example 1 was repeated, except that the first fine conductive particles were changed to fine conductive particles C and the second fine conductive particles were changed to second fine conductive particles 4, to thereby prepare carrier 16 and developer 16.

Comparative Example 2

The procedure of Comparative Example 1 was repeated, except that the second fine conductive particles were changed to second fine conductive particles 5, to thereby prepare carrier 17 and developer 17.

Comparative Example 3

The procedure of Comparative Example 2 was repeated, except that the amount of the second fine conductive particles (fine conductive particles 5) was changed to 115.9 parts, to thereby prepare carrier 18 and developer 18.

Comparative Example 4

The procedure of Comparative Example 3 was repeated, except that the first fine conductive particles were changed to fine conductive particles D and the amount of fine conductive particles 5 was changed to 22.1 parts, to thereby prepare carrier 19 and developer 19.

Comparative Example 5

The procedure of Comparative Example 4 was repeated, except that the second fine conductive particles were changed to fine conductive particles 7, to thereby prepare carrier 20 and developer 20.

Comparative Example 6

The procedure of Example 3 was repeated, except that a resin coating film-forming solution was prepared from the following components, to thereby prepare carrier 21 and developer 21.

Acrylic resin solution (solid content: 50% by mass): 6.6 parts
Guanamine solution (solid content: 70% by mass): 2.1 parts
Acid catalyst (solid content: 40% by mass): 0.04 parts
Silicone resin solution: 31 parts
[solid content: 20% by mss (SR2410, manufactured by TORAY DOW CORNING SILICONE CO., LTD.)]
Aminosilane: 0.04 parts
[solid content: 100% by mass (SH6020, manufactured by TORAY DOW CORNING SILICONE CO., LTD.)]
First fine conductive particles: fine conductive particles D: 11.0 parts
Second fine conductive particles: second fine conductive particles 1: 11.0 parts
Toluene: 133 parts Comparative Example 7

The procedure of Example 9 was repeated, except that the first fine conductive particles were not used (only the second fine conductive particles were used), to thereby prepare carrier 22 and developer 22.

The conditions and results of Examples and Comparative Examples are shown in Tables 2-1 and 2-2.

TABLE 2-1

| | First fine conductive particles | | Second fine conductive particles | | Dispersion | |
|---|---|---|---|---|---|---|
| | Type | Amount | Type | Amount | Conditions | Time |
| Ex. 1 | Conductive particles A | 231.7 | Conductive particles 1 | 231.7 | Homomixer | 10 min |
| Ex. 2 | Conductive particles A | 231.7 | Conductive particles 1 | 231.7 | Vibration-type or beads mill | 10 min |
| Ex. 3 | Conductive particles A | 231.7 | Conductive particles 1 | 231.7 | Vibration-type or beads mill | 60 min |
| Ex. 4 | Conductive particles A | 231.7 | Conductive particles 3 | 231.7 | Homomixer | 10 min |
| Ex. 5 | Conductive particles A | 231.7 | Conductive particles 3 | 231.7 | Vibration-type or beads mill | 10 min |
| Ex. 6 | Conductive particles A | 231.7 | Conductive particles 3 | 231.7 | Vibration-type or beads mill | 60 min |
| Ex. 7 | Conductive particles B | 231.7 | Conductive particles 6 | 231.7 | Homomixer | 10 min |
| Ex. 8 | Conductive particles B | 231.7 | Conductive particles 6 | 231.7 | Vibration-type or beads mill | 10 min |
| Ex. 9 | Conductive particles B | 231.7 | Conductive particles 6 | 231.7 | Vibration-type or beads mill | 60 min |
| Ex. 10 | Conductive particles C | 231.7 | Conductive particles 2 | 231.7 | Homomixer | 10 min |
| Ex. 11 | Conductive particles C | 231.7 | Conductive particles 2 | 231.7 | Vibration-type or beads mill | 10 min |
| Ex. 12 | Conductive particles C | 231.7 | Conductive particles 2 | 231.7 | Vibration-type or beads mill | 60 min |
| Ex. 13 | Conductive particles D | 231.7 | Conductive particles 3 | 231.7 | Vibration-type or beads mill | 60 min |
| Ex. 14 | Conductive particles A | 115.9 | Conductive particles 3 | 115.9 | Vibration-type or beads mill | 60 min |
| Ex. 15 | Conductive particles A | 22.1 | Conductive particles 3 | 22.1 | Vibration-type or beads mill | 60 min |
| Comp. Ex. 1 | Conductive particles C | 231.7 | Conductive particles 4 | 231.7 | Homomixer | 10 min |
| Comp. Ex. 2 | Conductive particles C | 231.7 | Conductive particles 5 | 231.7 | Homomixer | 10 min |
| Comp. Ex. 3 | Conductive particles C | 231.7 | Conductive particles 5 | 115.9 | Vibration-type or beads mill | 60 min |
| Comp. Ex. 4 | Conductive particles D | 231.7 | Conductive particles 5 | 22.1 | Vibration-type or beads mill | 60 min |
| Comp. Ex. 5 | Conductive particles D | 231.7 | Conductive particles 7 | 22.1 | Vibration-type or beads mill | 60 min |
| Comp. Ex. 6 | Conductive particles D | 11 | Conductive particles 8 | 11 | Vibration-type or beads mill | 60 min |
| Comp. Ex. 7 | None | 0 | Conductive particles 6 | 231.7 | Vibration-type or beads mill | 60 min |

TABLE 2-2

| | R1 Log(Ω · cm) | R2 Log(Ω · cm) | D1 nm | D2 nm | R1 × R2 | D1/D2 | Thickness of carrier coating film μm |
|---|---|---|---|---|---|---|---|
| Ex. 1 | 0.5 | 3 | 400 | 600 | 1.5 | 0.7 | 1 |
| Ex. 2 | 0.5 | 3 | 400 | 550 | 1.5 | 0.7 | 1 |
| Ex. 3 | 0.5 | 3 | 400 | 500 | 1.5 | 0.8 | 1 |
| Ex. 4 | 0.5 | 1.5 | 400 | 1,000 | 0.75 | 0.4 | 1 |
| Ex. 5 | 0.5 | 1.5 | 400 | 300 | 0.75 | 1.3 | 1 |
| Ex. 6 | 0.5 | 1.5 | 400 | 50 | 0.75 | 8.0 | 1 |
| Ex. 7 | 2 | −1.8 | 400 | 500 | −3.6 | 0.8 | 1 |
| Ex. 8 | 2 | −1.8 | 400 | 200 | −3.6 | 2.0 | 1 |
| Ex. 9 | 2 | −1.8 | 400 | 50 | −3.6 | 8.0 | 1 |
| Ex. 10 | 2 | 2.5 | 250 | 800 | 5 | 0.3 | 1 |
| Ex. 11 | 2 | 2.5 | 250 | 400 | 5 | 0.6 | 1 |
| Ex. 12 | 2 | 2.5 | 250 | 200 | 5 | 1.3 | 1 |
| Ex. 13 | 5 | 1.5 | 400 | 50 | 7.5 | 8.0 | 1 |
| Ex. 14 | 0.5 | 1.5 | 400 | 50 | 0.75 | 8.0 | 0.5 |
| Ex. 15 | 0.5 | 1.5 | 400 | 50 | 0.75 | 8.0 | 0.1 |
| Comp. Ex. 1 | 2 | 7 | 250 | 3,000 | 14 | 0.1 | 1 |
| Comp. Ex. 2 | 2 | 4 | 250 | 4,000 | 8 | 0.1 | 1 |
| Comp. Ex. 3 | 2 | 4 | 250 | 50 | 8 | 5.0 | 1 |

TABLE 2-2-continued

| | R1 Log(Ω · cm) | R2 Log(Ω · cm) | D1 nm | D2 nm | R1 × R2 | D1/D2 | Thickness of carrier coating film μm |
|---|---|---|---|---|---|---|---|
| Comp. Ex. 4 | 5 | 4 | 400 | 50 | 20 | 8.0 | 1 |
| Comp. Ex. 5 | 5 | 0.3 | 400 | 25 | 1.5 | 16.0 | 1 |
| Comp. Ex. 6 | 5 | 4.2 | 400 | 25 | 20.9 | 16.0 | 0.01 |
| Comp. Ex. 7 | — | −1.8 | — | 50 | — | — | 1 |

TABLE 3

| | Initial resistance Log(Ω · cm) | Initial charge μc/g | Resistance adjustability | Edge effect | Fineness | Toner scattering | Color mixing | Durability | | | | |
|---|---|---|---|---|---|---|---|---|---|---|---|---|
| | | | | | | | | Solid carrier adhesion | Post-running resistance | Change in resistance | Post-running charge | Reduced amount of charge |
| Ex. 1 | 11 | 30 | B | A | A | B | A | A | 10 | 1 | 28 | 2 |
| Ex. 2 | 11 | 30 | B | A | A | B | A | A | 10.5 | 0.5 | 27 | 3 |
| Ex. 3 | 11.5 | 32 | B | A | A | B | A | A | 11.5 | 0 | 28 | 4 |
| Ex. 4 | 10 | 30 | B | A | A | B | A | B | 9 | 1 | 30 | 0 |
| Ex. 5 | 11 | 30 | B | A | A | B | A | A | 10.5 | 0.5 | 29 | 1 |
| Ex. 6 | 13.5 | 35 | C | B | B | C | A | A | 13 | 0.5 | 30 | 5 |
| Ex. 7 | 9 | 28 | A | A | A | C | B | B | 9.5 | −0.5 | 27 | 1 |
| Ex. 8 | 9.5 | 29 | A | A | A | C | B | B | 9.5 | 0 | 25 | 4 |
| Ex. 9 | 11 | 30 | B | A | A | A | A | A | 11 | 0 | 23 | 7 |
| Ex. 10 | 12 | 33 | B | A | A | A | A | A | 10 | 2 | 33 | 0 |
| Ex. 11 | 12 | 33 | B | A | A | A | A | A | 10.5 | 1.5 | 33 | 0 |
| Ex. 12 | 13 | 35 | C | B | B | C | A | A | 12.5 | 0.5 | 32 | 3 |
| Ex. 13 | 14 | 35 | C | B | B | C | A | A | 14 | 0 | 30 | 5 |
| Ex. 14 | 13 | 33 | B | A | A | C | A | A | 11 | 2 | 28 | 5 |
| Ex. 15 | 12 | 30 | B | A | A | A | A | A | 9.5 | 2.5 | 24 | 6 |
| Comp. Ex. 1 | 15.5 | 35 | D | C | C | D | C | D | 8 | 7.5 | 20 | 15 |
| Comp. Ex. 2 | 15.5 | 35 | D | C | C | D | C | D | 8.5 | 7 | 21 | 14 |
| Comp. Ex. 3 | 14 | 35 | D | C | C | D | C | D | 9 | 5 | 24 | 11 |
| Comp. Ex. 4 | 16 | 40 | D | C | C | D | C | C | 12.5 | 3.5 | 19 | 21 |
| Comp. Ex. 5 | 16 | 40 | D | C | C | E | C | C | 12 | 4 | 28 | 12 |
| Comp. Ex. 6 | 16.5 | 42 | D | D | D | E | C | C | 8 | 8.5 | 19 | 23 |
| Comp. Ex. 7 | 14 | 30 | D | D | D | D | D | C | 8 | 6 | 15 | 15 |

From the results of Examples and Comparative Examples, it was found that the present invention could provide a carrier and a two-component developer which can be controlled in resistance in a wide range, which involve no carrier adhesion, which provide good reproducibility of thin lines such as letters, which form high-fineness images with suppressed edge effects and without color stains, which stably change in charge amount even when the amount of toner consumed is small, which change in charge amount and resistance to a small extent with increasing of the running and thereby overcoming failures such as toner scattering and uneven image density, and which can maintain good image quality over a long period of time.

What is claimed is:

1. A latent electrostatic image developing carrier used for a two-component developer containing at least a toner and a carrier, the latent electrostatic image developing carrier comprising:

a carrier core material, and a coating layer containing a resin and provided on a surface of the carrier core material, wherein the coating layer comprises a particulate material containing at least first fine conductive particles and second fine conductive particles, and wherein the first fine conductive particles and the second fine conductive particles satisfy the relationships expressed by Expressions 1 and 2, $$0.3 \leqq D1/D2 \leqq 15 \quad \text{Expression 1}$$

where D1 denotes a dispersed particle diameter of the first fine conductive particles and D2 denotes a dispersed particle diameter of the second fine conductive particles, and $$-5 \leqq \log(R1 \times R2) \leqq 7.5 \quad \text{Expression 2}$$

where R1 denotes a powder specific resistance of the first fine conductive particles and R2 denotes a powder specific resistance of the second fine conductive particles.

2. The latent electrostatic image developing carrier according to claim 1, wherein the first fine conductive particles and the second fine conductive particles satisfy the relationship expressed by Expression 1-A:

$$0.3 \leqq D1/D2 \leqq 10 \quad \text{Expression 1-A.}$$

3. The latent electrostatic image developing carrier according to claim 1, wherein the first fine conductive particles and the second fine conductive particles satisfy the relationship expressed by Expression 1-B:

$$7 \leqq D1/D2 \leqq 8 \quad \text{Expression 1-B.}$$

4. The latent electrostatic image developing carrier according to claim 1, wherein the first fine conductive particles and the second fine conductive particles satisfy the relationship expressed by Expression 2-B:

$$-4 \leqq \log(R1 \times R2) \leqq 7.5 \quad \text{Expression 2-B.}$$

5. The latent electrostatic image developing carrier according to claim 1, wherein each of the first fine conductive particles comprises a tin oxide layer and a conductive coating layer provided thereon and made of an indium oxide layer containing tin dioxide, and each of the second fine conductive particles comprises fine tin oxide conductive particles.

6. The latent electrostatic image developing carrier according to claim 5, wherein the second fine conductive particles are fine conductive powder containing neither antimony nor indium, or containing at least one of antimony and indium in an amount equal to or lower than the detection limit by at least thermal analysis.

7. The latent electrostatic image developing carrier according to claim 5, wherein the second fine conductive particles contain carbon on surfaces thereof.

8. The latent electrostatic image developing carrier according to claim 1, wherein the particulate material is contained in the coating layer in such an amount that the coverage of the carrier core material with the particulate material is 30% to 90%.

9. The latent electrostatic image developing carrier according to claim 1, wherein the latent electrostatic image developing carrier has a volume specific resistance of $1\times10^{9}\,\Omega\cdot$cm to $1\times10^{17}\,\Omega\cdot$cm.

10. The latent electrostatic image developing carrier according to claim 1, wherein the coating layer has an average thickness of 0.05 μm to 4.00 μm.

11. The latent electrostatic image developing carrier according to claim 10, wherein the coating layer has an average thickness of 0.05 μm to 2.00 μm.

12. The latent electrostatic image developing carrier according to claim 1, wherein the latent electrostatic image developing carrier has a weight average particle diameter of 20 μm to 65 μm.

13. The latent electrostatic image developing carrier according to claim 1, wherein the resin contained in the coating layer contains a silicone resin.

14. The latent electrostatic image developing carrier according to claim 1, wherein the resin contained in the coating layer contains an acrylic resin.

15. The latent electrostatic image developing carrier according to claim 1, wherein the resin contained in the coating layer contains at least an acrylic resin and a silicone resin.

16. The latent electrostatic image developing carrier according to claim 1, wherein the latent electrostatic image developing carrier has a magnetization of 40 $Am^2/kg$ to 90 $Am^2/kg$ at a magnetic field of 1 kOe.

17. The latent electrostatic image developing carrier according to claim 1, wherein D1 is from 250 to 400 nm and D2 is from 50 to 1,000 nm.

18. A two-component developer comprising:

a toner, and a latent electrostatic image developing carrier, wherein the latent electrostatic image developing carrier comprises a carrier core material, and a coating layer containing a resin and provided on a surface of the carrier core material, wherein the coating layer comprises a particulate material containing at least first fine conductive particles and second fine conductive particles, and wherein the first fine conductive particles and the second fine conductive particles satisfy the relationships expressed by Expressions 1 and 2, $$0.3 \leqq D1/D2 \leqq 15 \quad \text{Expression 1}$$

where D1 denotes a dispersed particle diameter of the first fine conductive particles and D2 denotes a dispersed particle diameter of the second fine conductive particles, and $$-5 \leqq \log(R1 \times R2) \leqq 7.5 \quad \text{Expression 2}$$

where R1 denotes a powder specific resistance of the first fine conductive particles and R2 denotes a powder specific resistance of the second fine conductive particles.

19. The two-component developer according to claim 18, wherein the toner is a color toner.

20. An image forming method comprising:

forming an image with a two-component developer, wherein the two-component developer comprises a toner and a latent electrostatic image developing carrier, wherein the latent electrostatic image developing carrier comprises a carrier core material, and a coating layer containing a resin and provided on a surface of the carrier core material, wherein the coating layer comprises a particulate material containing at least first fine conductive particles and second fine conductive particles, and wherein the first fine conductive particles and the second fine conductive particles satisfy the relationships expressed by Expressions 1 and 2, $$0.3 \leqq D1/D2 \leqq 15 \quad \text{Expression 1}$$

where D1 denotes a dispersed particle diameter of the first fine conductive particles and D2 denotes a dispersed particle diameter of the second fine conductive particles, and $$-5 \leqq \log(R1 \times R2) \leqq 7.5 \quad \text{Expression 2}$$

where R1 denotes a powder specific resistance of the first fine conductive particles and R2 denotes a powder specific resistance of the second fine conductive particles.

* * * * *